US009743502B2

(12) United States Patent
Okamoto

(10) Patent No.: US 9,743,502 B2
(45) Date of Patent: Aug. 22, 2017

(54) ESD PROTECTION DEVICE

(71) Applicant: Murata Manufacturing Co., Ltd., Kyoto (JP)

(72) Inventor: Masanori Okamoto, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 403 days.

(21) Appl. No.: 14/600,137

(22) Filed: Jan. 20, 2015

(65) Prior Publication Data

US 2015/0131193 A1 May 14, 2015

Related U.S. Application Data

(63) Continuation of application No. PCT/JP2013/070180, filed on Jul. 25, 2013.

(30) Foreign Application Priority Data

Aug. 13, 2012 (JP) ..... 2012-179355

(51) Int. Cl.
*H05F 3/04* (2006.01)
*H01T 2/02* (2006.01)
(Continued)

(52) U.S. Cl.
CPC ..... *H05F 3/04* (2013.01); *H01B 1/02* (2013.01); *H01T 1/20* (2013.01); *H01T 2/02* (2013.01); *H01T 4/12* (2013.01); *H01B 3/12* (2013.01)

(58) Field of Classification Search
CPC ..... H05F 3/04; H01B 1/02
See application file for complete search history.

(56) References Cited

U.S. PATENT DOCUMENTS 7,633,735 B2 * 12/2009 Urakawa ..... H01T 4/12 361/112
2011/0038088 A1 * 2/2011 Noma ..... H01T 4/08 361/112
(Continued)

FOREIGN PATENT DOCUMENTS

JP 2010-129320 A 6/2010
JP 2010-129323 A 6/2010
(Continued)

OTHER PUBLICATIONS

Written Opinion of the International Search Authority for Application No. PCT/JP2013/070180 dated Aug. 20, 2013.

*Primary Examiner* — Scott Bauer
(74) *Attorney, Agent, or Firm* — Pearne & Gordon LLP

(57) ABSTRACT

An ESD protection device 1 includes a ceramic insulating material 10, first and second discharge electrodes 21 and 22, and a discharge auxiliary section 51. The discharge auxiliary section 51 is an electrode configured to reduce a discharge starting voltage between the first discharge electrode 21 and the second discharge electrode 22. The discharge auxiliary section 51 comprises a sintered body including conductive particles and at least one of semiconductor particles and insulating particles. At least the discharge auxiliary section 51 comprises at least one of an alkaline metal component and a boron component. The content of at least one of the alkaline metal component and the boron component in the discharge auxiliary section 51 is larger than the content of at least one of the alkaline metal component and the boron component in the ceramic insulating material 10.

20 Claims, 2 Drawing Sheets

(51) Int. Cl.

| | |
|---|---|
| ***H01T 4/12*** | (2006.01) |
| ***H01T 1/20*** | (2006.01) |
| ***H01B 1/02*** | (2006.01) |
| *H01B 3/12* | (2006.01) |

(56) References Cited

U.S. PATENT DOCUMENTS

| | | | | |
|---|---|---|---|---|
| 2011/0216456 | A1 * | 9/2011 | Yamamoto | H01T 4/12 361/56 |
| 2012/0250196 | A1 | 10/2012 | Sumi et al. | |

FOREIGN PATENT DOCUMENTS

| | | | | |
|---|---|---|---|---|
| JP | 2012-074269 | A | 4/2012 | |
| WO | WO 2010061522 | A1 * | 6/2010 | H01T 4/12 |

* cited by examiner

ESD PROTECTION DEVICE

BACKGROUND OF THE INVENTION

Field of the Invention

The present invention relates to an ESD protection device.

Description of the Related Art

Heretofore, various types of ESD protection devices which suppress destruction of electronic apparatuses caused by electro-static discharge (ESD) have been proposed. For example, Patent Document 1 has disclosed an ESD protection device which includes a pair of discharge electrodes disposed in a ceramic insulating material and a discharge auxiliary section provided so as to be in contact with the pair of discharge electrodes.

Patent Document 1: Japanese Unexamined Patent Application Publication No. 2010-129320

BRIEF SUMMARY OF THE INVENTION

A ceramic insulating material of an ESD protection device is formed, for example, by sintering a green sheet multilayer body which is a multilayer body formed of ceramic green sheets. In order to improve the sintering characteristics of the green sheet multilayer body, the addition of a sintering agent, such as an alkaline metal component and/or a boron component, to the green sheet multilayer body may be considered. However, in general, the sintering agent is likely to be vaporized. Hence, the sintering agent is vaporized during the sintering of the green sheet multilayer body, and as a result, the concentration of the sintering agent tends to be varied. The variation in the concentration of the sintering agent causes the variation in its contraction rate and the like. As a method for suppressing the vaporization of the sintering agent, it is considered to perform sintering in a closed sheath; however, when the sintering is performed in a closed sheath, the productivity of ESD protection devices is disadvantageously reduced.

Because of the problems as described above, no addition of the sintering agent to the green sheet multilayer body may also be considered in some cases. In this case, the vaporization of the sintering agent from the green sheet multilayer body is not required to be taken into consideration. Hence, the green sheet multilayer body may be sintered in an open sheath. However, in this case, the discharge auxiliary section which is, in general, not likely to be sintered as compared to the green sheet multilayer body is insufficiently sintered, and as a result, there may be a problem in that sufficiently excellent ESD properties may not be obtained in some cases.

A primary object of the present invention is to provide an ESD protection device having excellent ESD properties.

An ESD protection device of the present invention comprises a ceramic insulating material, a first and a second discharge electrode, and a discharge auxiliary section. The first and second discharge electrodes are provided for the ceramic insulating material. The discharge auxiliary section is disposed between a distal end portion of the first discharge electrode and a distal end portion of the second discharge electrode. The discharge auxiliary section is an electrode functioning to decrease a discharge starting voltage between the first and second discharge electrodes. The discharge auxiliary section is formed of a sintered body containing conductive particles and at least one of semiconductor particles and insulating particles. At least the discharge auxiliary section of the ceramic insulating material and the discharge auxiliary section contains at least one of an alkaline metal component and a boron component. The content of at least one of the alkaline metal component and the boron component in the discharge auxiliary section is larger than the content of at least one of the alkaline metal component and the boron component in the ceramic insulating material.

According to a specific aspect of the ESD protection device of the present invention, the content of at least one of the alkaline metal component and the boron component in the discharge auxiliary section is 0.5 percent by mole or more.

According to another specific aspect of the ESD protection device of the present invention, the content of at least one of the alkaline metal component and the boron component in the ceramic insulating material is 0.5 percent by mole or less.

According to another specific aspect of the ESD protection device of the present invention, the ceramic insulating material contains a glass component.

According to another specific aspect of the ESD protection device of the present invention, the first and the second discharge electrodes are each provided on a surface of the ceramic insulating material.

According to another specific aspect of the ESD protection device of the present invention, the first and the second discharge electrodes are each provided in the ceramic insulating material.

According to another specific aspect of the ESD protection device of the present invention, the ceramic insulating material has a cavity. The first and the second discharge electrodes are provided so that distal end portions thereof are located in the cavity.

According to another specific aspect of the ESD protection device of the present invention, the ESD protection device further comprises a first outer electrode disposed on the ceramic insulating material and electrically connected to the first discharge electrode and a second outer electrode disposed on the ceramic insulating material and electrically connected to the second discharge electrode.

According to the present invention, an ESD protection device having excellent ESD properties can be provided.

DETAILED DESCRIPTION OF THE INVENTION

Figure 1:
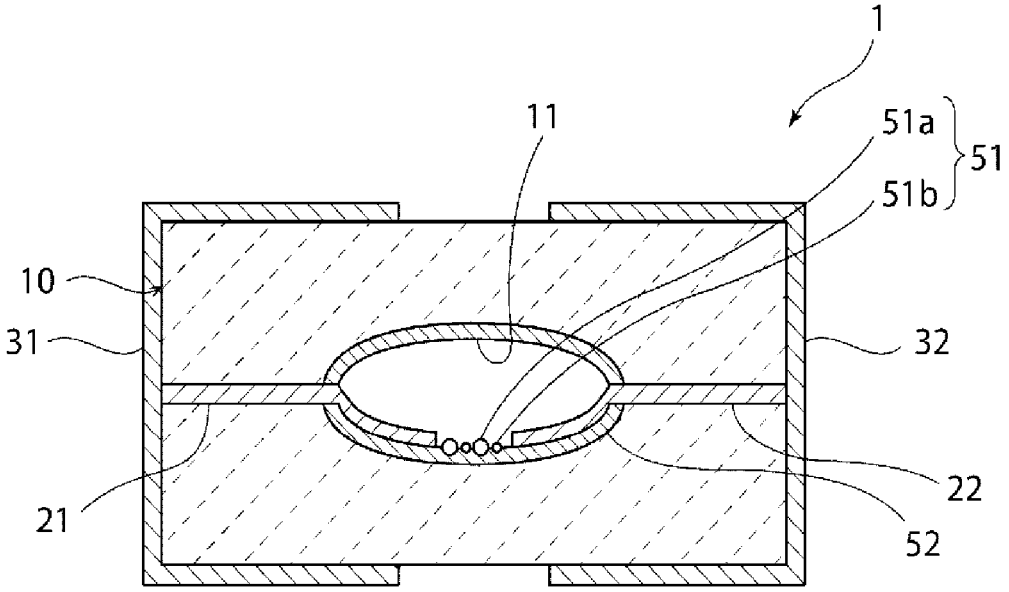
FIG. 1 is a schematic cross-sectional of an ESD protection device according to a first embodiment.

Hereinafter, one example of the preferable embodiments of the present invention will be described. However, the following embodiments are merely shown by way of example. The present invention is not limited at all to the following embodiments.

In addition, in the drawings referred in the embodiments and the like, members having substantially the same function are designated by the same reference numeral. In addition, the drawings referred in the embodiments and the like are each schematically drawn, and for example, the ratio of dimensions of an object drawn in the drawing may be different from the ratio of dimensions of an actual object in some cases. In addition, between the drawings, for example, the ratio of dimensions of an object may be different from each other in some cases. For example, the ratio of dimensions of a concrete object should be judged in consideration of the following description.

FIG. 1 is a schematic cross-sectional of an ESD protection device according to this embodiment.

As shown in FIG. 1, an ESD protection device 1 includes a ceramic insulating material 10 having a cavity 11. The ceramic insulating material 10 has a rectangular parallelepiped shape. The ceramic insulating material 10 may be formed from an appropriate insulating ceramic. In particular, the ceramic insulating material 10 may be formed, for example, from a low temperature co-fired ceramics (LTCC) containing Ba, Al, and Si as primary components. The ceramic insulating material 10 may contain at least one of an alkaline metal component and a boron component. The ceramic insulating material 10 preferably contains a glass component.

The ceramic insulating material 10 is provided with first and second discharge electrodes 21 and 22. The first and the second discharge electrodes 21 and 22 are disposed inside the ceramic insulating material 10. The distal end portion of the first discharge electrode 21 and the distal end portion of the second discharge electrode 22 are located in the cavity 11. The distal end portion of the first discharge electrode 21 and the distal end portion of the second discharge electrode 22 face each other in the cavity 11. By the structure as described above, besides improvement in responsibility of the ESD protection device 1, the durability thereof can also be improved.

In addition, the distal end portion of the first discharge electrode 21 and the distal end portion of the second discharge electrode 22 are not always required to face each other. For example, the distal end portion of the first discharge electrode 21 may be located on one inner surface of the cavity 11, and the distal end portion of the second discharge electrode 22 may be located on another inner surface of the cavity 11. That is, as long as the distal end portion of the first discharge electrode 21 and the distal end portion of the second discharge electrode 22 are configured to generate discharge, the shapes of the first and the second discharge electrodes 21 and 22 and the arrangement thereof are not particularly limited.

In addition, a plurality of sets of the first and the second discharge electrodes 21 and 22 may be provided.

On outer surfaces of the ceramic insulating material 10, first and second outer electrodes 31 and 32 are provided. The first outer electrode 31 is electrically connected to the first discharge electrode 21. The second outer electrode 32 is electrically connected to the second discharge electrode 22.

In addition, each of the first and the second discharge electrodes 21 and 22 and the first and the second outer electrodes 31 and 32 may be each formed from an appropriate material, such as Cu, Ag, Pd, Pt, Al, Ni, W, or an alloy containing at least one of those mentioned above.

Between the distal end portion of the first discharge electrode 21 and the distal end portion of the second discharge electrode 22, a discharge auxiliary section 51 is disposed. The discharge auxiliary section 51 has a function to reduce the discharge starting voltage between the first discharge electrode 21 and the second discharge electrode 22. In particular, since the discharge auxiliary section 51 is provided, besides creeping discharge and air discharge, discharge through the discharge auxiliary section 51 is also generated. In general, among the creeping discharge, the air discharge, and the discharge through the discharge auxiliary section 51, the starting voltage of the discharge through the discharge auxiliary section 51 is lowest. Hence, when the discharge auxiliary section 51 is provided, the discharge starting voltage between the first discharge electrode 21 and the second discharge electrode 22 can be decreased. Accordingly, the insulation breakdown of the ESD protection device 1 can be suppressed. In addition, since the discharge auxiliary section 51 is provided, the response of the ESD protection device 1 can be improved.

The discharge auxiliary section 51 is formed of a sintered body containing first particles 51*a* and second particles 51*b*. The particle diameter of the first particles 51*a* is larger than that of the second particles 51*b*. The particle diameter of the first particles 51*a* may be set, for example, to approximately 2 to 3 μm. The particle diameter of the second particles 51*b* may be set, for example, to approximately 0.1 to 1 μm.

The first particles 51*a* are formed of conductive particles. The second particles 51*b* are formed of at least one of semiconductor particles and insulating particles. In this case, the semiconductor particles may be particles having at least a surface layer formed from a semiconductor material, and are not limited to particles formed entirely from a semiconductor material. The insulating particles may be particles having at least a surface layer formed from an insulating material, and are not limited to particles formed entirely from an insulating material.

The second particles 51*b* may be formed only of semiconductor particles, may be formed only of insulating particles, or may be formed of semiconductor particles and insulating particles. As particular examples of preferably used conductive particles, for example, Cu particles and Ni particles may be mentioned. The conductive particles may be coated with an insulating material or a semiconductor material. Specific examples of the preferably used semiconductor particles include, for example, particles formed of a carbide, such as silicon carbide, titanium carbide, zirconium carbide, molybdenum carbide, or tungsten carbide; particles formed of a nitride, such as titanium nitride, zirconium nitride, chromium nitride, vanadium nitride, or tantalum nitride; particles formed of a silicide, such as titanium silicide, zirconium silicide, tungsten silicide, molybdenum silicide, or chromium silicide; particles formed of a boride, such as titanium boride, zirconium boride, chromium boride, lantern boride, molybdenum boride, or tungsten boride; and particles formed of an oxide, such as zinc oxide or strontium titanate. Specific examples of preferably used insulating particles include, for example, aluminum oxide particles.

The discharge auxiliary section 51 contains at least one of an alkaline metal component and a boron component. Specific examples of the preferably used alkaline metal components include, for example, potassium, sodium, lithium, and rubidium. The content of at least one of the alkaline metal component and the boron component in the discharge auxiliary section 51 is larger than the content of at least one of the alkaline metal component and the boron component in the ceramic insulating material 10. The content of at least one of the alkaline metal component and the boron component in the discharge auxiliary section 51 is preferably 5 to 300 times that in the ceramic insulating material 10 and more preferably 10 to 100 times. The content of at least one of the alkaline metal component and the boron component in the discharge auxiliary section 51 is preferably 0.5 to 30 percent by mole and more preferably 1 to 10 percent by mole. The content of at least one of the alkaline metal component and the boron component in the ceramic insulating material 10 is preferably 0.5 percent by mole or less and more preferably 0.3 percent by mole or less.

The discharge auxiliary section 51 may contain a glass component.

Between the ceramic insulating material 10 and at least one distal end portion of the first and the second discharge electrodes 21 and 22, a protective layer 52 is provided. In particular, the protective layer 52 is provided so as to cover substantially the whole inner wall of the cavity 11. Since the protective layer 52 is provided, the component contained in the ceramic insulating material 10 is suppressed from reaching the distal end portion. Hence, degradation in discharge characteristics, which is caused by degradation of the first and the second discharge electrodes 21 and 22 of the ESD protection device 1, can be suppressed.

The protective layer 52 is preferably formed from a ceramic having a sintering temperature higher than that of a ceramic forming the ceramic insulating material 10. The ceramic insulating material 10 preferably contains at least one type selected from the group consisting of alumina, mullite, zirconia, magnesia, and quartz.

Next, one example of a method for manufacturing the ESD protection device 1 will be described.

First, ceramic green sheets forming the ceramic insulating material 10 are prepared. The ceramic green sheets preferably contain a glass component. The ceramic green sheets may contain an alkaline metal component and/or a boron component. The ceramic green sheets may contain as the alkaline metal component, for example, an alkaline metal oxide such as potassium oxide, an alkaline metal carbonate, and/or an alkaline metal nitrate.

Next, in order to form the discharge auxiliary section, a discharge auxiliary section-forming paste is applied on a ceramic green sheet, so that a discharge auxiliary section-forming paste layer is formed. In addition, a conductive paste forming the discharge electrodes is applied on a ceramic green sheet, so that conductive paste layers are formed. A resin paste forming the cavity 11 is applied on a ceramic green sheet, so that a resin paste layer is formed. In addition, the discharge auxiliary section-forming paste layer contains the first particles 51*a* and the second particles 51*b* and also contains at least one of an alkaline metal component and a boron component. In the discharge auxiliary section-forming paste layer, the first particles 51*a* may be each coated, for example, with an insulating layer formed of aluminum oxide. As the resin paste, for example, a poly (ethylene terephthalate) resin, a polypropylene resin, or an acrylic resin is preferably used.

Subsequently, the ceramic green sheet provided with the discharge auxiliary section-forming paste layer on the surface thereof, the ceramic green sheet provided with the conductive paste layer on the surface thereof, the ceramic green sheet provided with the resin paste layer on the surface thereof, and the ceramic green sheet provided with no layers on the surface thereof are appropriately laminated to each other, so that a green sheet multilayer body is formed.

Next, the green sheet multilayer body is sintered. Subsequently, the first and the second outer electrodes 31 and 32 are formed on the sintered body, for example, by plating or firing of a conductive paste, so that the ESD protection device 1 can be completed. In addition, the sintering of the green sheet multilayer body can be performed, for example, at a temperature of approximately 850° C. to 1,000° C.

As described above, in the ESD protection device 1, at least the discharge auxiliary section 51 of the ceramic insulating material 10 and the discharge auxiliary section 51 contains at least one of the alkaline metal component and the boron component. In addition, the content of at least one of the alkaline metal component and the boron component in the discharge auxiliary section 51 is larger than the content of at least one of the alkaline metal component and the boron component in the ceramic insulating material 10. Hence, when the sintering agent, such as an alkaline metal component and/or a boron component, is not added, a preferable sintering temperature of the discharge auxiliary section, which is generally higher than that of the ceramic insulating material, can be decreased. As a result, the difference in preferable sintering temperature between the ceramic insulating material 10 and the discharge auxiliary section 51 can be decreased. Hence, the ceramic insulating material 10 and the discharge auxiliary section 51 can both be preferably sintered. Accordingly, excellent ESD properties can be realized.

In addition, when the content of at least one of the alkaline metal component and the boron component in the ceramic insulating material 10 is set to 0.5 percent by mole or less, the generation of the variation in the component concentration caused by the vaporization of the alkaline metal component and/or the boron component can be suppressed during the sintering of the ceramic insulating material 10. Hence, the ESD protection device 1 can be manufactured even in an open sheath. Accordingly, a high productivity can be realized. In order to realize a higher productivity, the content of at least one of the alkaline metal component and the boron component in the ceramic insulating material 10 is preferably 0.3 percent by mole or less and more preferably 0.1 percent by mole or less, and furthermore, the ceramic insulating material 10 preferably contains substantially no alkaline metal component nor boron component.

In addition, when the ceramic insulating material 10 contains a glass component, the viscosity of the glass component is decreased during the sintering by the alkaline metal component and/or the boron component contained in the discharge auxiliary section 51. As a result, the sintering characteristics of the ceramic insulating material 10 are improved.

Figure 2:
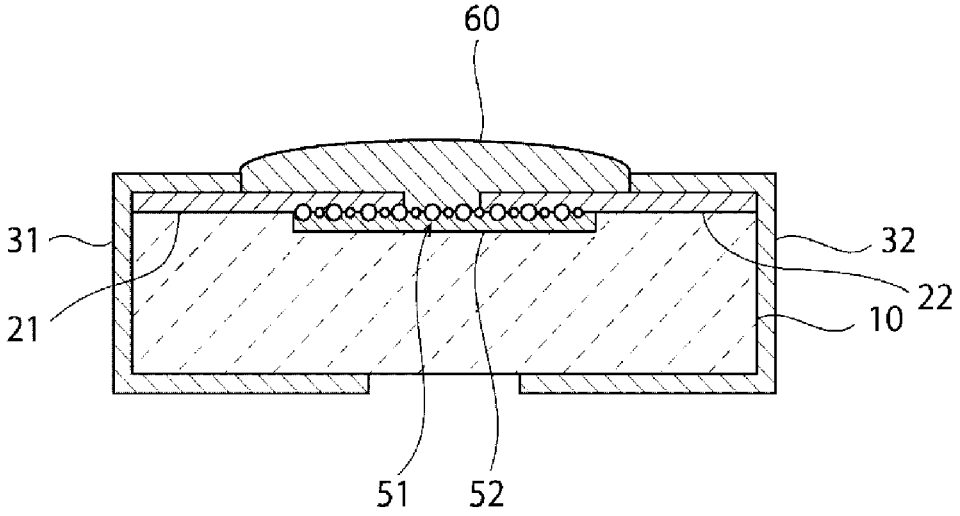
FIG. 2 is a schematic cross-sectional of an ESD protection device according to a second embodiment.

In addition, in this embodiment, the case in which the first and second discharge electrodes 21 and 22 are provided in the ceramic insulating material 10 is described by way of example. However, the present invention is not limited to the structure described above. For example, as shown in FIG. 2, the first and second discharge electrodes 21 and 22 may be provided on the surface of the ceramic insulating material 10. In this case, a protective layer 60 is preferably provided on the ceramic insulating material 10 so as to cover the distal end portions of the first and second discharge electrodes 21 and 22. The protective layer 60 may be formed, for example, from a resin.

Figure 3:
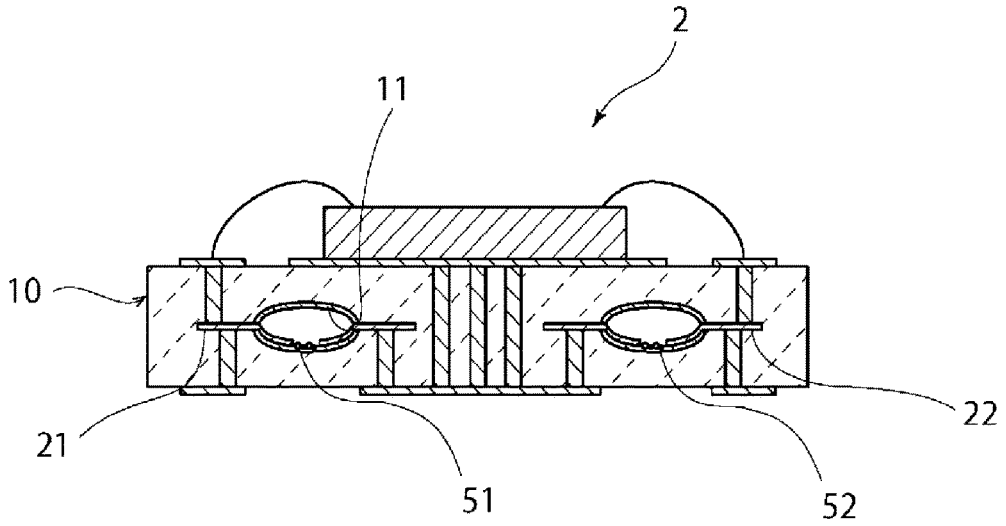
FIG. 3 is a schematic cross-sectional of an ESD protection device according to a third embodiment.

In addition, as shown in FIG. 3, an ESD protection device 2 may be integrally formed together with a wiring board. That is, the ESD protection device 2 may form an ESD protection-mechanism incorporating wiring substrate which incorporates an ESD protection mechanism having an ESD protection function.

Figure 4:
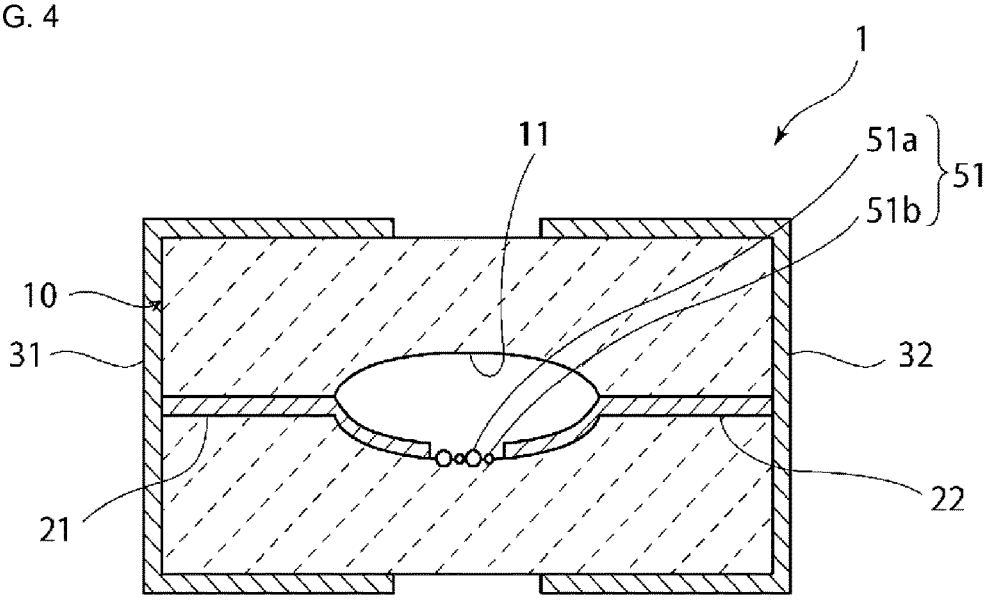
FIG. 4 is a schematic cross-sectional of an ESD protection device according to a fourth embodiment.

In addition, as shown in FIG. 4, the ESD protection device may not be provided with the protective layer 52.

Comparative Example 1

Under the following conditions, an ESD protection device having substantially the same structure as that of the ESD protection device 1 according to the above embodiment was formed by the method described in the above embodiment.

Ceramic used for forming ceramic insulating material: ceramic containing Ba, Al, and Si as primary components Discharge electrode, outer electrode, inner electrode: Cu Dimensions of ESD protection device: 1.0 mm in length, 0.5 mm in width, 0.3 mm in thickness Width of discharge electrode: 100 μm Distance of discharge gap: 30 μm Content of alkaline metal component (K) in discharge auxiliary section: 0 percent by mole Content of alkaline metal component (K) in ceramic insulating material: 0 percent by mole Sintering: open sheath Example 1

Except that the content of the alkaline metal component (K) in the discharge auxiliary section was set to 0.5 percent by mole, an ESD protection device was formed in a manner similar to that of Comparative Example 1.

Example 2

Except that the content of the alkaline metal component (K) in the discharge auxiliary section was set to 1 percent by mole, an ESD protection device was formed in a manner similar to that of Comparative Example 1.

Example 3

Except that the content of the alkaline metal component (K) in the discharge auxiliary section was set to 5 percent by mole, an ESD protection device was formed in a manner similar to that of Comparative Example 1.

Example 4

Except that the content of the alkaline metal component (K) in the discharge auxiliary section was set to 10 percent by mole, an ESD protection device was formed in a manner similar to that of Comparative Example 1.

Example 5

Except that the content of the alkaline metal component (K) in the discharge auxiliary section was set to 30 percent by mole, an ESD protection device was formed in a manner similar to that of Comparative Example 1.

Example 6

Except that the content of the alkaline metal component (K) in the discharge auxiliary section was set to 40 percent by mole, an ESD protection device was formed in a manner similar to that of Comparative Example 1.

Example 7

Except that the content of the alkaline metal component (K) in the ceramic insulating material was set to 0.1 percent by mole, an ESD protection device was formed in a manner similar to that of Example 3.

Example 8

Except that the content of the alkaline metal component (K) in the ceramic insulating material was set to 0.5 percent by mole, an ESD protection device was formed in a manner similar to that of Example 3.

Example 9

Except that the content of the alkaline metal component (K) in the ceramic insulating material was set to 1 percent by mole, an ESD protection device was formed in a manner similar to that of Example 3.

Comparative Example 2

Except that the content of the alkaline metal component (K) in the ceramic insulating material was set to 5 percent by mole, an ESD protection device was formed in a manner similar to that of Example 3.

In addition, in Comparative Example 2, after the sintering was performed, a phenomenon in which some ESD protection devices were adhered to the sheaths was observed.

Comparative Example 3

Except that the content of the alkaline metal component (K) in the ceramic insulating material was set to 10 percent by mole, an ESD protection device was formed in a manner similar to that of Example 3.

In addition, in Comparative Example 3, after the sintering was performed, a phenomenon in which many ESD protection devices were adhered to the sheaths was observed.

The clamp voltage (discharge starting voltage) and the insulation resistance (log IR) of the ESD protection device each formed in Comparative Examples 1 to 3 and Examples 1 to 9 were measured. The results are shown in Tables 1 and 2.

TABLE 1

| | Comparative Example 1 | Example 1 | Example 2 | Example 3 | Example 4 | Example 5 | Example 6 |
|---|---|---|---|---|---|---|---|
| Content of K in discharge auxiliary section | 0 mol % | 0.5 mol % | 1 mol % | 5 mol % | 10 mol % | 30 mol % | 40 mol % |
| Content of K in ceramic insulating material | 0 mol % | 0 mol % | 0 mol % | 0 mol % | 0 mol % | 0 mol % | 0 mol % |
| Clamp voltage | 682 V | 199 V | 58 V | 50 V | 52 V | 56 V | 46 V |
| Insulation resistance (logIR) | 12.1 Ω | 12.6 Ω | 12.3 Ω | 12.3 Ω | 11.5 Ω | 3.6 Ω | 0.3 Ω |

TABLE 2

| | Example 3 | Example 7 | Example 8 | Example 9 | Comparative Example 2 | Comparative Example 3 |
|---|---|---|---|---|---|---|
| Content of K in discharge auxiliary section | 5 mol % | 5 mol % | 5 mol % | 5 mol % | 5 mol % | 5 mol % |
| Content of K in ceramic insulating material | 0 mol % | 0.1 mol % | 0.5 mol % | 1 mol % | 5 mol % | 10 mol % |
| Clamp voltage | 50 V | 50 V | 50 V | 48 V | 42 V | 46 V |
| Insulation resistance (logIR) | 12.3 Ω | 12.3 Ω | 12.3 Ω | 12.4 Ω | 11.6 Ω | 11 Ω |

As apparent from Tables 1 and 2, it is found that when the content of the alkaline metal component in the discharge auxiliary section is set to be larger than the content of the alkaline metal component in the ceramic insulating material, the clamp voltage can be decreased. It is found that in order to achieve a lower clamp voltage, the content of the alkaline metal component in the discharge auxiliary section is preferably 0.5 percent by mole or more and more preferably 1 percent by mole or more.

In addition, although the clamp voltage was also low in Comparative Examples 2 and 3, the phenomenon in which the ESD protection device was adhered to the sheath occurred, and as a result, the ESD protection device could not be preferably sintered in an open sheath. In order to enable the ESD protection device to be preferably sintered in an open sheath, it is found that the content of the alkaline metal component in the ceramic insulating material is preferably 1 percent by mole or less. In addition, the reason the ESD protection device is liable to be adhered to the sheath when the content of the alkaline metal component and/or the boron component in the ceramic insulating material is high is believed that the content of the glass component in the ceramic insulating material is excessively increased by the alkaline metal component and/or the boron component.

In addition, in Example 6 in which the content of the alkaline metal component in the discharge auxiliary section was 40 percent by mole, the insulation resistance was low, such as 0.3Ω. In order to realize a high insulation resistance, it is found that the content of the alkaline metal component in the discharge auxiliary section is preferably 30 percent by mole or less and more preferably 10 percent by mole or less.

1 ESD protection device
10 ceramic insulating material
11 cavity
21 first discharge electrode
22 second discharge electrode
31 first outer electrode
32 second outer electrode
51 discharge auxiliary section
51*a* first particle
51*b* second particle
52 protective layer
60 protective layer

The invention claimed is:

1. An ESD protection device comprising:

a ceramic insulating material;

a first discharge electrode and a second discharge electrode disposed in or on the ceramic insulating material; and a discharge auxiliary section located between a distal end portion of the first discharge electrode and a distal end portion of the second discharge electrode, the discharge auxiliary section being an electrode configured to reduce a discharge starting voltage between the first discharge electrode and the second discharge electrode and comprising a sintered body including conductive particles and at least one of semiconductor particles and insulating particles, wherein at least the discharge auxiliary section of the ceramic insulating material and the discharge auxiliary section comprises at least one of an alkaline metal component and a boron component, and a content of at least one of the alkaline metal component and the boron component in the discharge auxiliary section is larger a content of at least one of the alkaline metal component and the boron component in the ceramic insulating material.

2. The ESD protection device according to claim 1, wherein the content of the at least one of the alkaline metal component and the boron component in the discharge auxiliary section is 0.5 percent by mole or more.

3. The ESD protection device according to claim 1, wherein the content of the at least one of the alkaline metal component and the boron component in the ceramic insulating material is 0.5 percent by mole or less.

4. The ESD protection device according to claim 1, wherein the ceramic insulating material comprises a glass component.

5. The ESD protection device according to claim 1, wherein the first and second discharge electrodes are each disposed on a surface of the ceramic insulating material.

6. The ESD protection device according to claim 1, wherein the first and second discharge electrodes are each disposed inside the ceramic insulating material.

7. The ESD protection device according to claim 6, wherein the ceramic insulating material comprises a cavity, and the distal end portion of the first discharge electrode and the distal end portion of the second discharge electrode are located in the cavity.

8. The ESD protection device according to claim 1, further comprising:

a first outer electrode located on the ceramic insulating material and electrically connected to the first discharge electrode; and a second outer electrode located on the ceramic insulating material and electrically connected to the second discharge electrode.

9. The ESD protection device according to claim 2, wherein the content of the at least one of the alkaline metal component and the boron component in the ceramic insulating material is 0.5 percent by mole or less.

10. The ESD protection device according to claim 2, wherein the ceramic insulating material comprises a glass component.

11. The ESD protection device according to claim 3, wherein the ceramic insulating material comprises a glass component.

12. The ESD protection device according to claim 2, wherein the first and second discharge electrodes are each disposed on a surface of the ceramic insulating material.

13. The ESD protection device according to claim 3, wherein the first and second discharge electrodes are each disposed on a surface of the ceramic insulating material.

14. The ESD protection device according to claim 4, wherein the first and second discharge electrodes are each disposed on a surface of the ceramic insulating material.

15. The ESD protection device according to claim 2, wherein the first and second discharge electrodes are each disposed inside the ceramic insulating material.

16. The ESD protection device according to claim 3, wherein the first and second discharge electrodes are each disposed inside the ceramic insulating material.

17. The ESD protection device according to claim 4, wherein the first and second discharge electrodes are each disposed inside the ceramic insulating material.

18. The ESD protection device according to claim 2, further comprising:

a first outer electrode located on the ceramic insulating material and electrically connected to the first discharge electrode; and a second outer electrode located on the ceramic insulating material and electrically connected to the second discharge electrode.

19. The ESD protection device according to claim 3, further comprising:

a first outer electrode located on the ceramic insulating material and electrically connected to the first discharge electrode; and a second outer electrode located on the ceramic insulating material and electrically connected to the second discharge electrode.

20. The ESD protection device according to claim 4, further comprising:

a first outer electrode located on the ceramic insulating material and electrically connected to the first discharge electrode; and a second outer electrode located on the ceramic insulating material and electrically connected to the second discharge electrode.

* * * * *